US005997095A

United States Patent [19]

Powell et al.

[11] Patent Number: 5,997,095

[45] Date of Patent: Dec. 7, 1999

[54] SUPPORTING SEAT

[76] Inventors: Alan J Powell, 1 Corella Street; Adam Weaver, 4 Malcolm Street, both of Doncaster, Vic, Australia, 3108

[21] Appl. No.: 09/021,205

[22] Filed: Feb. 10, 1998

Related U.S. Application Data

[63] Continuation of application No. PCT/AU96/00519, Aug. 16, 1996.

[30] Foreign Application Priority Data

Aug. 16, 1995 [AU] Australia ..... 28581/95

[51] Int. Cl.[6] ..... A47C 7/02

[52] U.S. Cl. ..... 297/452.23; 297/452.21; 297/452.24

[58] Field of Search ..... 297/452.23, 452.14, 297/452.21, 452.24, 452.25, 452.29, 452.3, 452.31, 452.33, 452.34

[56] References Cited

U.S. PATENT DOCUMENTS

| | | | |
|---|---|---|---|
| 3,511,537 | 5/1970 | Ackermann | 297/452.21 |
| 3,740,096 | 6/1973 | Bridger | 297/452.25 |
| 4,489,982 | 12/1984 | Morrow . | |
| 4,500,137 | 2/1985 | Morehouse | 297/452.21 |
| 5,114,209 | 5/1992 | Dunn . | |
| 5,190,347 | 3/1993 | Shiow-Lan . | |
| 5,411,317 | 5/1995 | Faust et al. | 297/452.3 |
| 5,833,319 | 11/1998 | Davis | 297/452.23 |

FOREIGN PATENT DOCUMENTS

| | | | |
|---|---|---|---|
| 2858195 | 2/1996 | Australia . | |
| 0099236 | 1/1984 | European Pat. Off. . | |
| 2421597 | 11/1979 | France . | |
| 3440985 | 5/1986 | Germany | 297/452.3 |
| 3635166 | 4/1987 | Germany . | |
| 3544094 | 6/1987 | Germany | 297/452.21 |
| 558158 | 1/1975 | Switzerland . | |
| 950413 | 2/1964 | United Kingdom | 297/452.24 |
| WO9215232 | 9/1992 | WIPO . | |
| WO9604878 | 2/1996 | WIPO . | |

OTHER PUBLICATIONS

Derwent Abstract Accession No. 84–000036/01, class P26, BE 897027 A (Saint Huberj), Dec. 12, 1983.

*Primary Examiner*—Laurie K. Cranmer
*Attorney, Agent, or Firm*—Alan Kamrath; Oppenheimer, Wolff & Donnelly

[57] ABSTRACT

A seat for supporting the pelvis of the user in a correct physiological position substantially corresponding to the pelvic standing position. The seat has a dished gluteal position (16) which extends to the rear of the seat and a seat back (11) with a substantially convex upper portion (13) and a concave lower portion (12) with the distance between the junction (21) of the two and the lowest point (22) of the dished gluteal portion (16) substantially corresponding to the average dimension between the posterior superior spine of the ilia P and the ischial tuberosities (site bones) of an adult person.

9 Claims, 8 Drawing Sheets

SUPPORTING SEAT

CROSS REFERENCE

The application is a continuation of International Application Number PCT/AU96/00519 filed on Aug. 16, 1996.

TECHNICAL FIELD

This invention relates to a seat which is able to give specific support to the pelvis including the sacroiliac joint, the gluteal, iliac crest and ilio-lumbar areas.

BACKGROUND ART

There are many types of seats each with a different back rest profile. The majority of these seats are aimed at providing an S-shaped spine profile in order to provide particular support of the lower lumbar area. However these seats do not provide any support of the pelvic area and therefore allow incorrect positioning of the pelvis in relation to the spine and makes such chairs ineffective in providing true good posture.

It is known to have a seat design which attempts to support the pelvis but this is done by crude methods such as a projection extending from the lower part of the back rest that pushes upon the upper part of the pelvis to provide correct positioning of the pelvis. This is obviously extremely uncomfortable and because of the distancing of the back from the back rest does not provide support of the lower lumbar area. Another method is to have a flat bottom of the seat which tilts forwardly in order to obtain the correct position of the pelvis. However this does not allow for comfortable sitting and urges the back away from the back seat.

It is therefore an object of this invention to provide a seat which provides support to the pelvis while also allowing support of the lower back.

DISCLOSURE OF INVENTION

According to the invention there is provided a seat comprising a seat bottom and a seat back which can extend substantially upright relative to the seat bottom; the seat bottom having a dished gluteal portion for receiving the buttocks of a user and a raised front portion for tending to retain the user in the dished gluteal portion; the seat back having two lower sections, the first lower section positioned relative to the seat bottom to contact the posterior superior spine of the ilia while the user is seated and the second lower section positioned below the first lower section and part of a substantially concave lower portion of the seat back to support the upper and middle gluteal; the first lower section of the seat back and the lowest point of the dished gluteal portion are spaced relative to each other so as to have a specific Z-line dimension when in use corresponding to the average dimension between the posterior superior spine of the ilia and the ischial tuberosities (sit bones) of an adult person, and the concave lower portion of the seat back and the dished gluteal portion of the seat bottom being relatively positioned, whereby the two lower sections of the seat back and a lower section of the seat bottom around the lowest point of the dished gluteal portion are able to simultaneously support the pelvis of the user in a correct physiological sitting position for normal spinal integrity substantially corresponding to the pelvic standing position.

The present invention provides a seat which allows the user to adopt a seated position in which the sacroiliac joint, the buttocks and the lower back muscles are effectively supported allowing for comfort and the ability to be relaxed over extended periods. This is distinct from previous seating design that has attempted to provide back support with a definite lumbar only support mechanism or seating, or provide pelvic positioning without back support by angled seat bottom or by projections from seat back to cause a user to sit with their pelvis in a correct position.

The seat of the invention enables each individual to assume a position that is the most comfortable, stable and energy conserving postural position. It provides for relaxation of spinal muscles, from the pelvis through the lumbar, thoracic and cervical regions. The angle and contours, of the ischial-buttock support and the rear back support, prevents a forward slide of the ischia and back slump of the iliac crests.

The invention includes a seat bottom so arranged that a user is guided to sit with the body weight distributed between the thighs and the buttocks and the posterior support causes the body to adopt a position so that the gluteal and ilio-lumbar musculature are relaxed and comfortable.

The seat bottom has a dished gluteal area with a raised front portion which slopes downwards at the front similar to many current seats, however the dished area will be further to the rear than in current seating. The seat bottom although not significantly different to many other seats other than mentioned above, is an integral part to the invention because of the exact positioning of the dished gluteal area in relation to the seat back. The lower portion of the seat back is designed concave, both side to side and bottom up to iliac crest height. From the iliac crest upwards, the back becomes convex in its vertical profile and the side to side concavity becomes shallower.

The relationship of the seat bottom and the seat back and the shape are crucial in determining correct support for the human body and are determined by the characteristics of the substances the seat will be manufactured in. For example, a seat made with soft foam will mean a slightly different positioning of the seat bottom relative to the back, to that of a seat made with firm foam and will be distinctly different to a seat made in plastic or other hard form. There will also be differences in whether a foam is an overlay or the shape is cut or injection moulded in foam. The critical area of the invention is the relationship between the bottom seat support and the sacroiliac support of the rear member and the posterolateral support of the sacroiliac region of the upper pelvis. Because the difference between the ischia (sit bones) and the sacroiliac joints of large and small people is insignificant, in providing support of the pelvis a Z-line dimension can be established that will accommodate all adult pelvis sizes. The Z-line dimension will vary in the seats different applications depending on the above example. However in its hard form or at the end compression of a seat with foam, the dimension is 230 mm. This is the preferable dimension on all types of seating, when the user is seated.

The height of the seat back and the length of the seat bottom will vary according to the application of the invention.

BRIEF DESCRIPTION OF DRAWINGS

In order that the invention is understood, reference will be made to the accompanying drawings in which.

MODE FOR CARRYING OUT THE INVENTION

Figure 1:
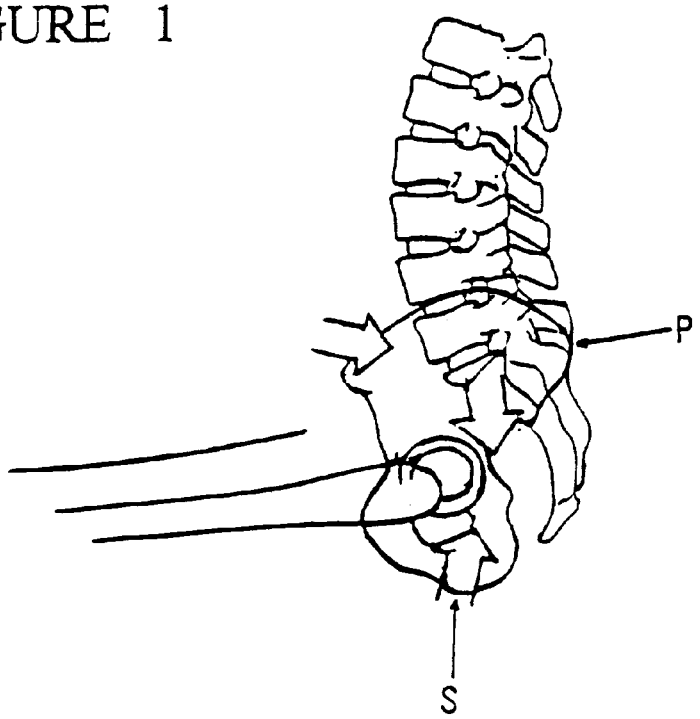
FIG. 1 shows a side view of the pelvis and lumbar spine in a correct seated position as is the case when a user uses the seat of invention.
Figure 2:
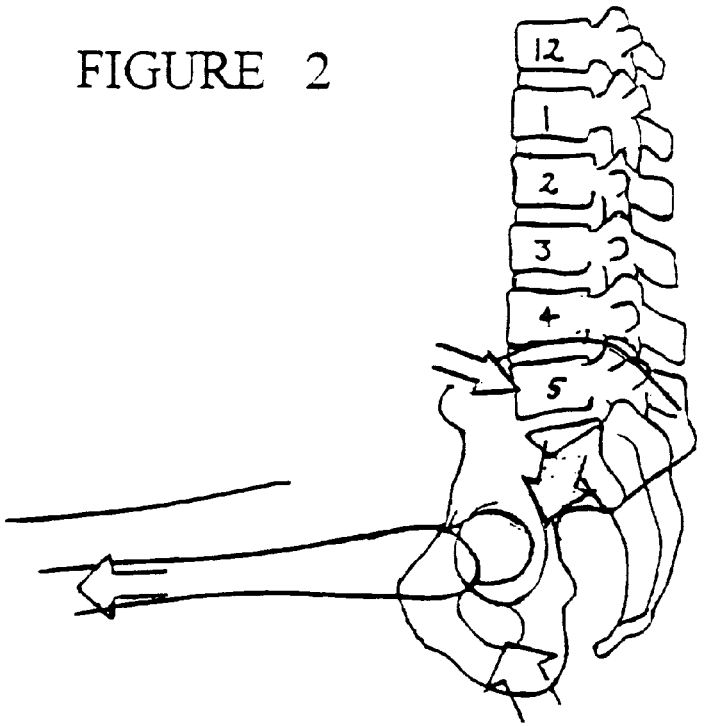
FIG. 2 shows the slumped body position of a user of a seat of the prior art where there is a lumbar support but where there is no correct support for the sacroiliac joint, the upper gluteal, iliolumbar muscles and iliac crest.

Referring to FIG. 2 there is shown the posture that occurs due to the incorrect rotation of the pelvis when in a sitting position in a seat of the prior art. The thick arrows show the forces applied to the pelvis which occurs by the slouching of the user due to the lack of pelvic support. This causes the force on the lower part of the pelvis and in particular the ischium (sit bones) at the bottom of the pelvis to be pushed forward and thereby cause an incorrect rotational position of the pelvis and a dragging of the spine such that it straightens out. However referring to FIG. 1 there is shown the correct positional support of the pelvis when a user is seated in a seat of the invention. The thick arrows indicate the forces applied to the pelvis. P indicates the posterior aspect of the ilium (Pelvis). S indicates the position of the Ischium (Sit Bones). As can be seen the force on the underneath part of pelvis is directed partially backwards so as to correctly forward rotate the pelvis and allow the natural curvature of the spine. This correct physiological position can be obtained by correct positioning of the posterior aspect of the ilium P and the correct positioning of the ischium (sit bones) S by the correct structure of the seat of the invention. The correct physiological sitting position for normal spinal integrity substantially corresponds to the pelvic standing position.

In accordance with an embodiment of the invention there is provided a seat which includes a seat back 11 and a seat bottom 15 where the seat back is positioned in an upright position relative to the seat bottom 15. FIGS. 3–9 show the shape and contours of the seat bottom and seat back and the relationship between them.

Figure 4:
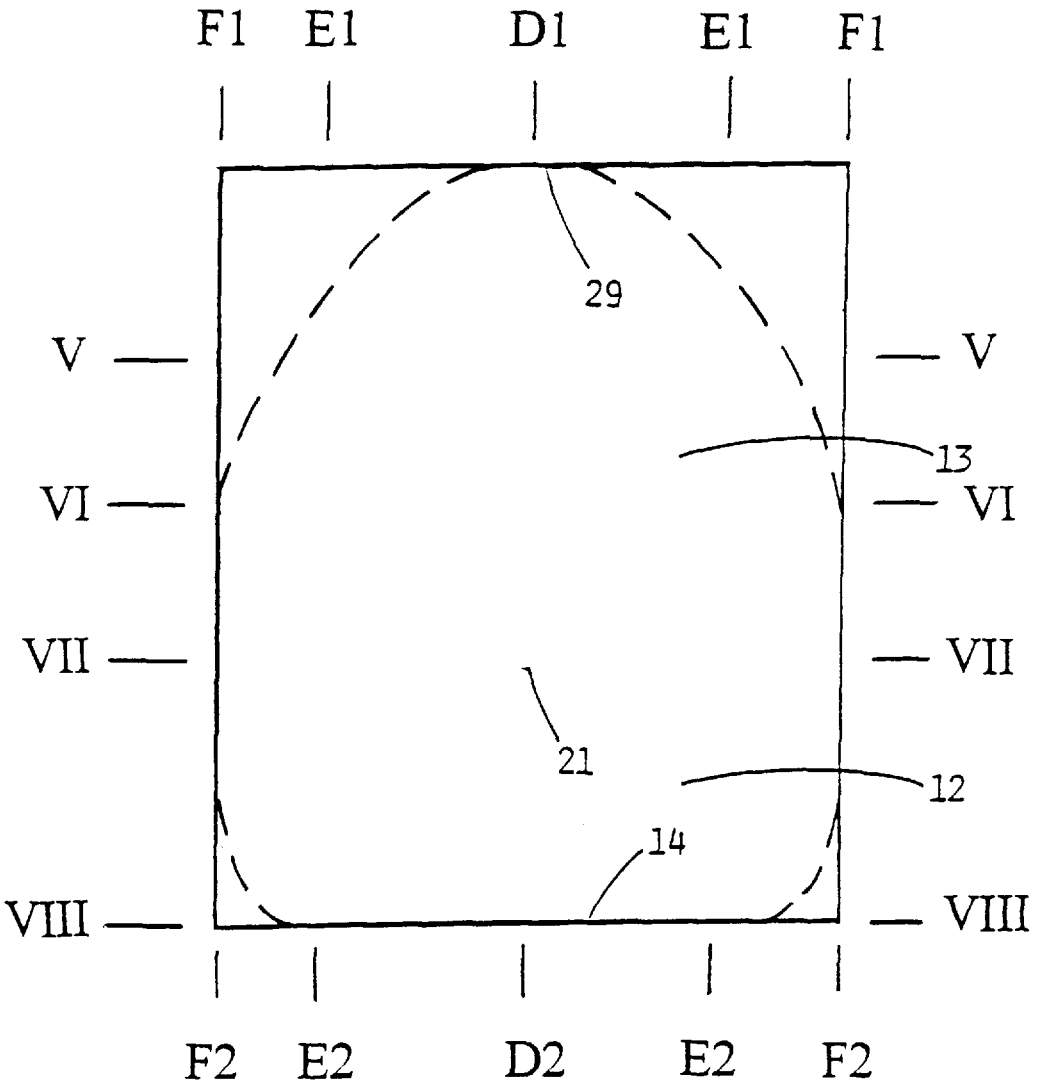
FIG. 4 is a diagrammatic front view of a seat back of the seat of FIG. 3 indicating cross section D, E, F and V, VI, VII and VIII.
Figure 5:
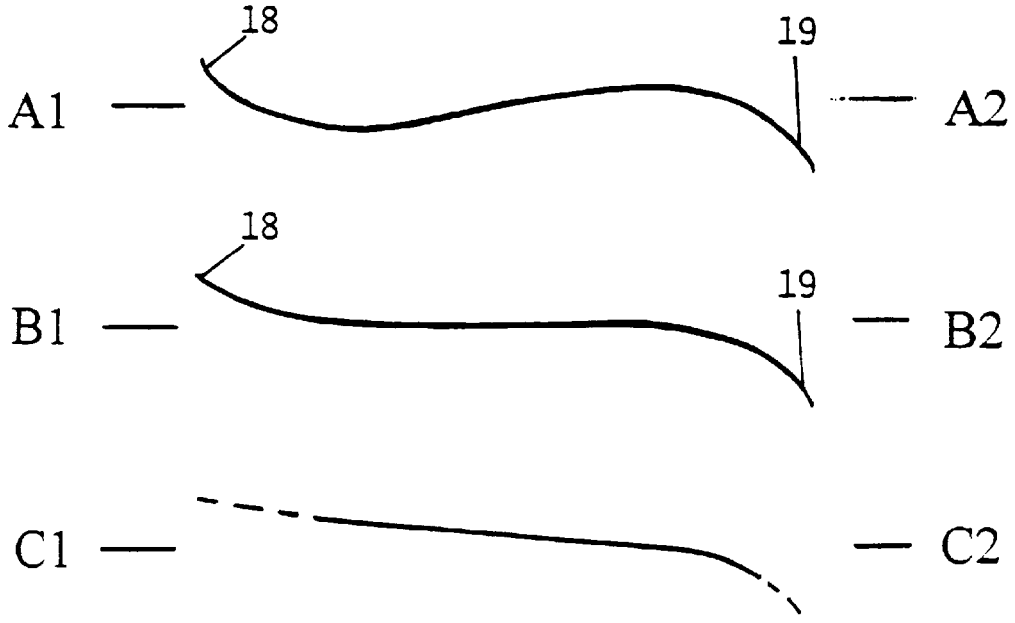
FIG. 5 are longitudinal cross sections of seat bottom of the seat of FIG. 3 at sectional lines A1 to A2, B1 to B2 and C1 to C2.
Figure 9:
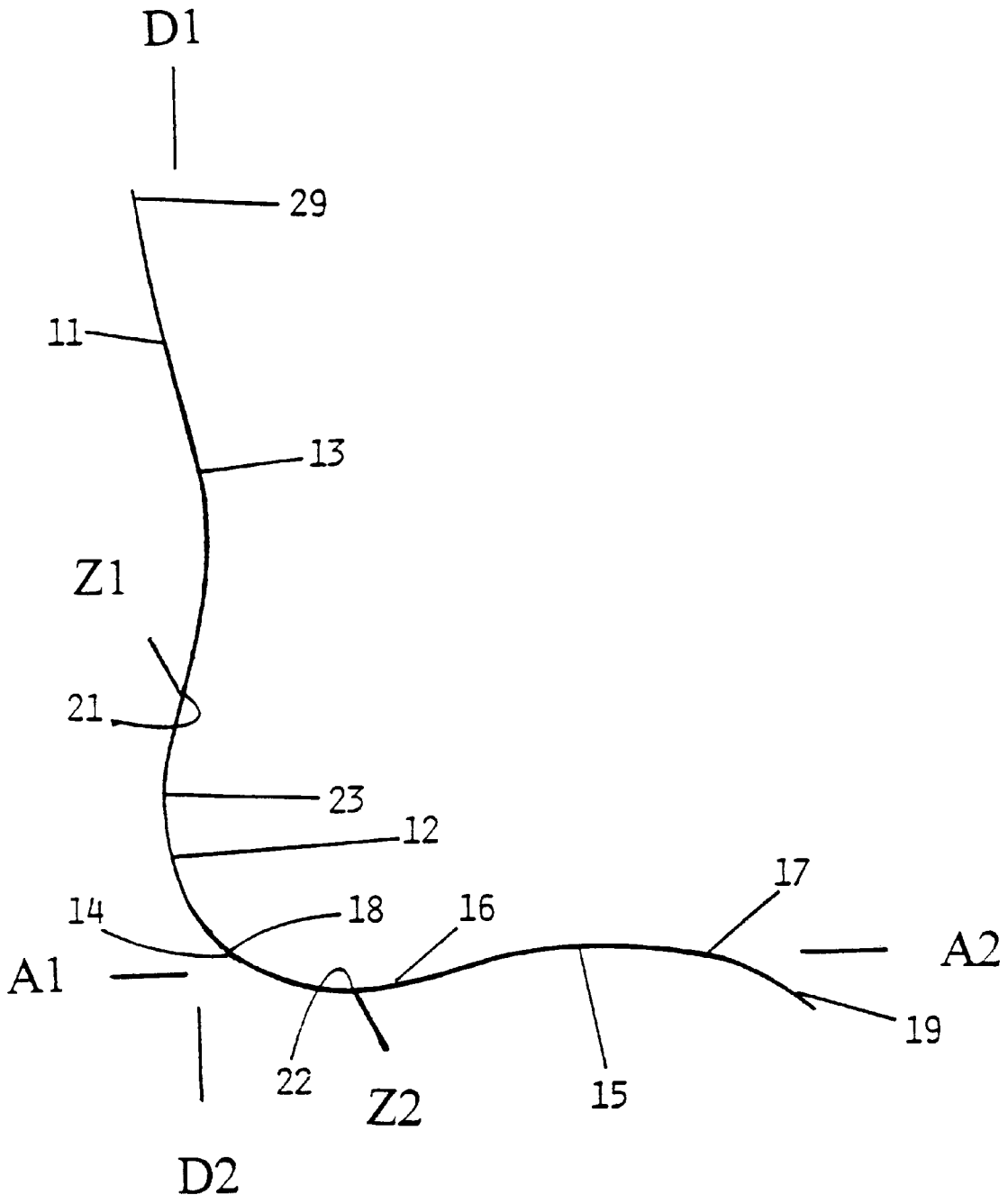
FIG. 9 shows a vertical cross sectional profile of a central front portion of a seat in accordance with the embodiment of the invention shown in FIGS. 3 to 8.

FIG. 9 shows a central vertical cross sectional profile of the front surface of a seat in accordance with one embodiment of the invention along the cross sectional lines D1 to D2 and A1 to A2 of FIGS. 4 and 5 respectively. The seat bottom 15 includes a dished gluteal portion 16 extending rearwardly towards the rear of the seat bottom 18 and forwardly to a front convex portion 17 extending to the front edge of the seat 19. The seat back 11 comprises a concave lower portion 12 extending from the bottom of the seat back 14 up to and connecting with an upper portion 13 of the seat back which is substantially convex in shape extending up to the top of the seat 29.

In the embodiment shown the seat back 11 and seat bottom 15 are formed in one piece such that the bottom of the seat back 14 connects with the rear of the seat bottom 18. The concave lower portion 12 has a central vertical fixed radius of curvature which extends from a top point 21 to the bottom of the seat back 14. The dished gluteal portion 16 extends from the uppermost part of the convex front portion 17 of the seat bottom 15 through a lowest central point 22 of the dished gluteal portion 16 to the rear of the seat bottom 18 at the same height as the uppermost part of the convex front portion 17 of the seat bottom 15. In this form of the invention, in which the seat back 11 and seat bottom 15 are in one piece, the bottom of the seat back 14 and the rear of the seat bottom 18 corresponds with the rear of the dished gluteal portion 16. However, in some other embodiments of the invention the bottom of the seat back 14 may not correspond with the rear of the dished gluteal portion 16, but be spaced therefrom.

The seat back 11 includes two lower sections 21 and 23 with the first lower section positioned relative to the seat bottom 15 so as to contact the posterior superior spine of the ilia while the user is seated and being located at the junction 21 of the substantially convex upper portion 13 of the seat back 11 and the substantially concave lower portion 12 of the seat back 11. This junction 21 is located about 170 mm above the rear of the seat bottom 18 corresponding to the rear of the dished gluteal area 16. The second lower section 23 is part of the lower concave portion 12 of the seat back 11 and is positioned below the first lower section 21 and extends therefrom so as in use to be able to support the upper and middle gluteal musculature. The second section 23 in the single piece form of the seat shown in this embodiment of the invention extends all the way down to the bottom of the seat back 14 corresponding with the rear of the gluteal area 16. The lower concave portion 12 of the seat back 11 has a central vertical cross sectional fixed radius of curvature which is different to the radius of curvature of the dished gluteal portion 16 of the seat bottom 15 as the curvature needed to support the upper and middle gluteal is different to the curvature needed to support the buttocks of the user of the seat.

Along the central cross sectional front profile of the seat of the invention, as shown in FIG. 9, a Z-line can be drawn which extends in a straight line from the top central point Z1 at the junction 21 of the substantially convex upper portion 13 and the substantially concave lower portion 12 to the lowest central point 22 of the dished gluteal area 16 on the seat bottom 15. When the seat is in use and the cushioning is compressed the dimension of the Z-line corresponds to the average dimension between the posterior superior spine of the ilia and the ischial tuberosities (sit bones) of an adult person. Generally this would have the dimension of 230 mm. The line Z1–Z2 will differ in its dimension depending on the material used in its manufacture. The rounded corners and edges and external shape of the seat is for aesthetics and not part of the invention as this will be different in each application.

Figure 3:
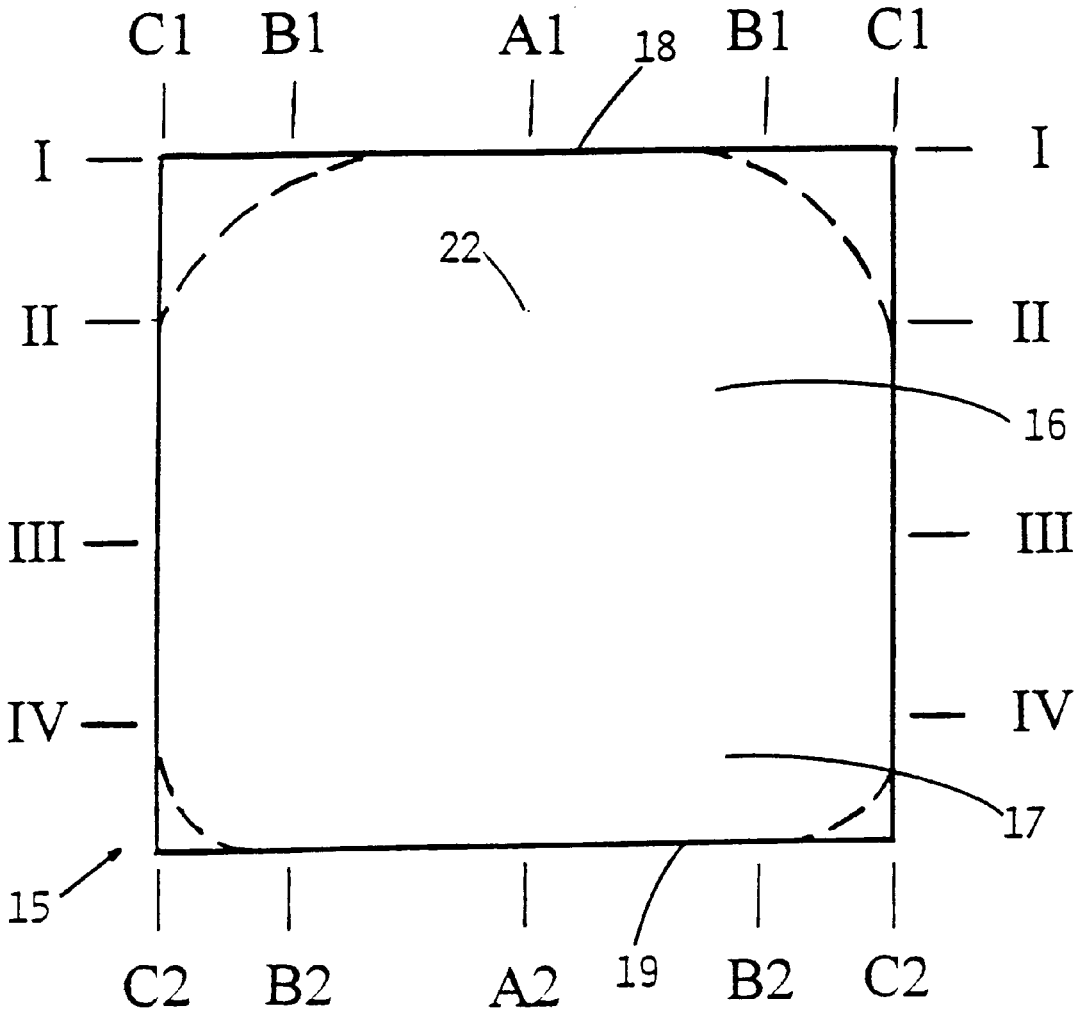
FIG. 3 is an overhead diagrammatic plan view of a seat bottom of the seat in accordance with one embodiment of the invention indicating cross section lines at A, B, C and I, II, III, IV.
Figure 6:
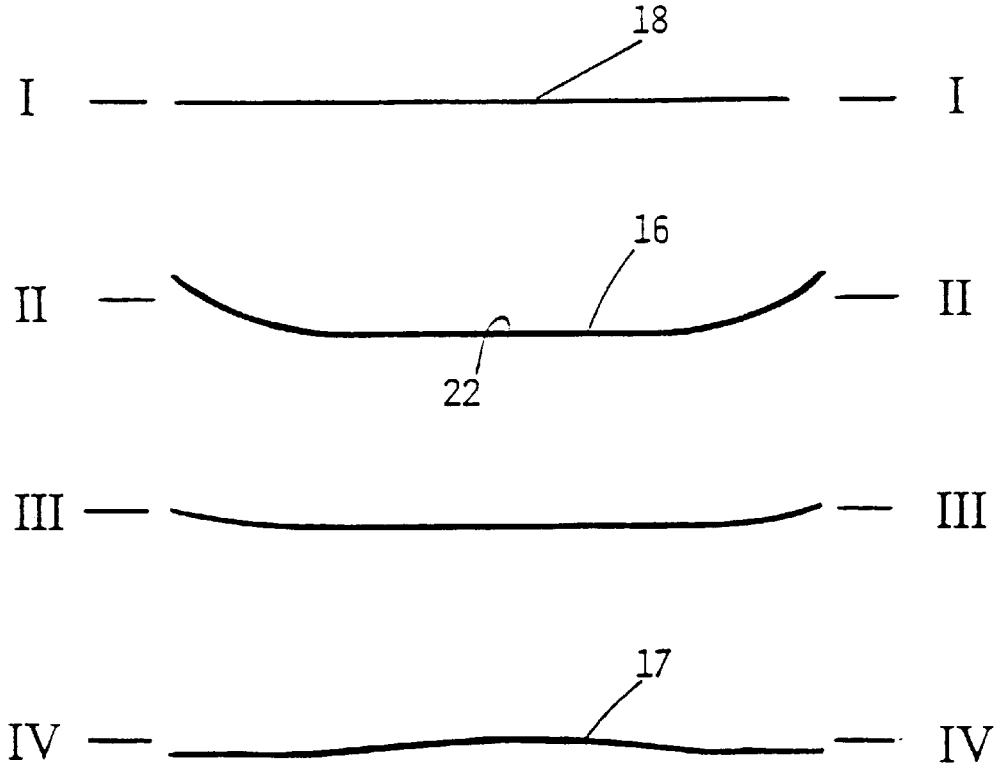
FIG. 6 are transverse cross sections of seat bottom of the seat of FIG. 4 at the sectional lines I, II, III, and IV.

Referring to FIG. 3 there is shown the seat bottom 15 with ends of longitudinal cross sectional lines extending from the rear of the seat 18 at A1, B1 and C1 to front of the seat 19 at A2, B2 and C2 respectively and transverse cross sectional lines from the rear of the seat bottom 18 at I to near the front of seat bottom 19 at IV. The transverse cross sectional lines 1-11-111-1V are across seat 1 at rear 18, 11 is 100 mm from the rear 18 at the point where the sit bones S and Z2 are situated, 111 is at the centre, and IV is near the front 19 of the seat bottom 15. Profiles of this seat bottom 15 along the longitudinal and transverse cross sectional lines are shown in FIGS. 5 and 6 respectively.

Figure 7:
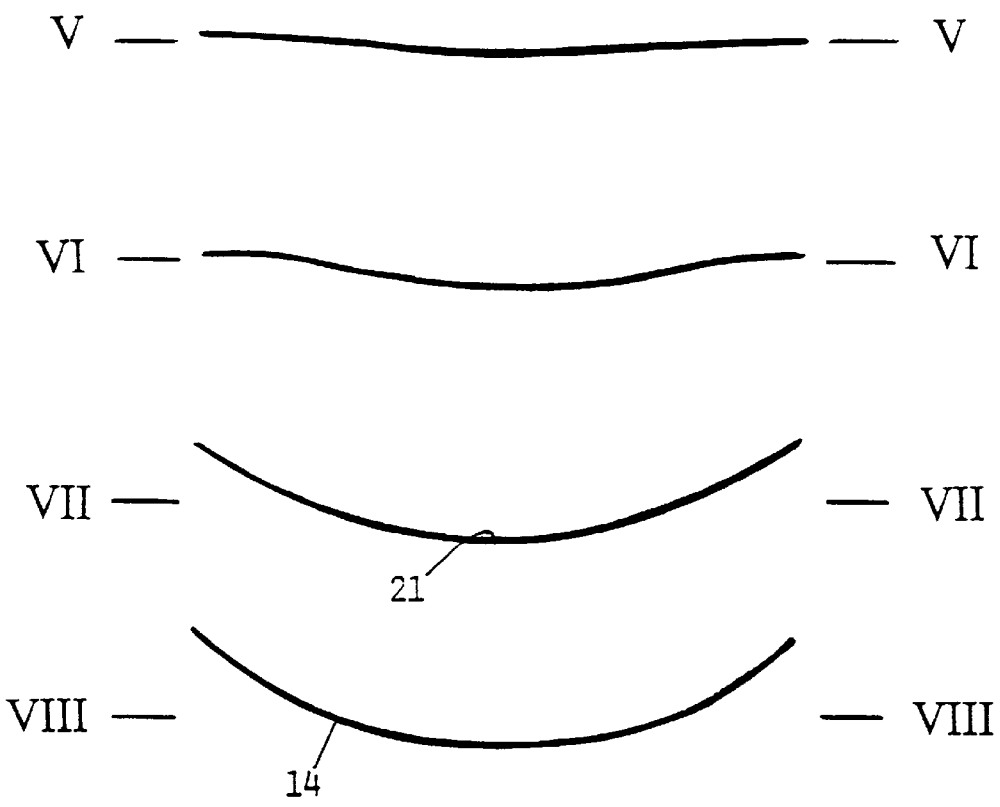
FIG. 7 are longitudinal cross sections of seat back of FIG. 4 at along lines D1 to D2, E1 to E2 and F1 to F2.
Figure 8:
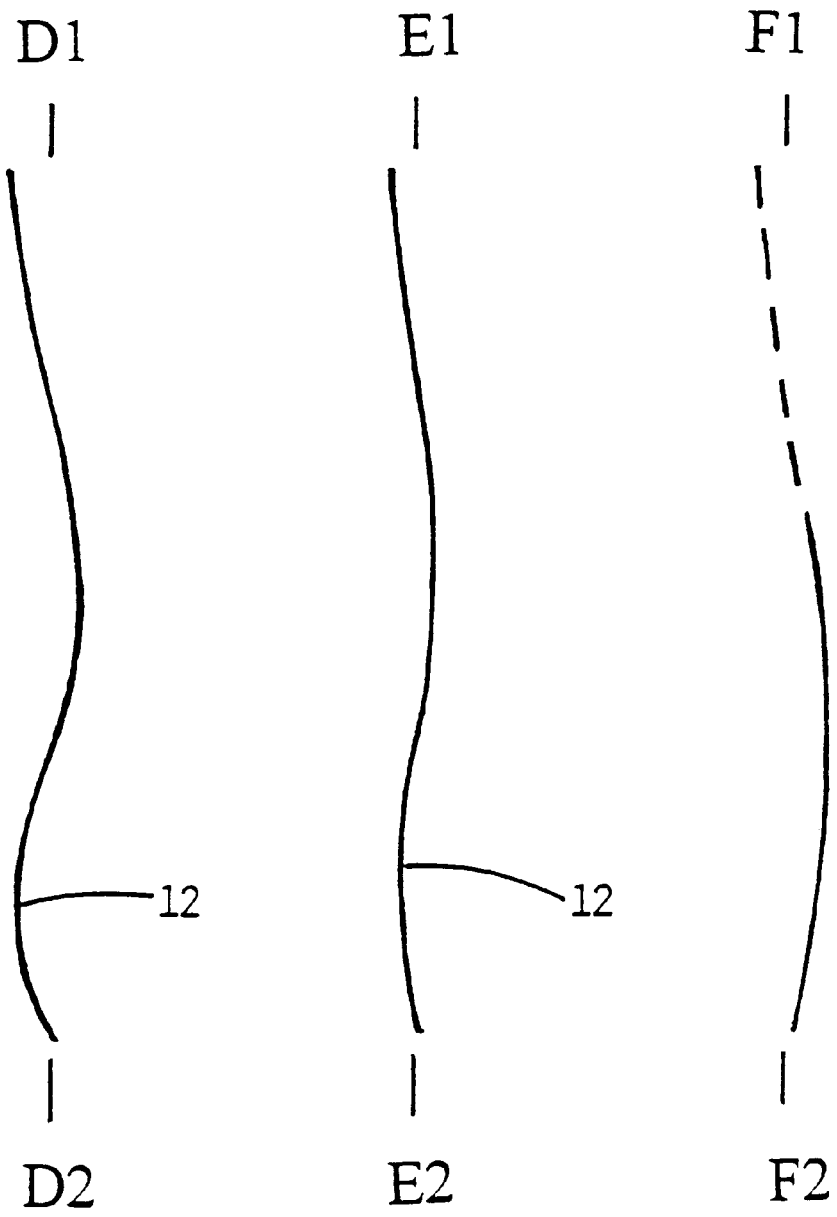
FIG. 8 are transverse sections of seat back of FIG. 4 along lines V, VI, VII and VIII.

Referring to FIG. 4 there is shown the seat back 11 with longitudinal cross sectional lines extending from the top 29 at D1, E1, F1 through to the bottom 14 of the seat back 11 at D2, E2, F2 and transverse cross sectional lines V–V111 across seat back 11. Profiles of the seat back 11 along the transverse and longitudinal cross sectional lines are shown in FIGS. 7 and 8 respectively. Shaped top and bottom are aesthetics and the top can be extended to head rest height. The transverse cross sectional line V111 is across the bottom 14 of the seat back 11, line V11 is 170 mm from the bottom 14 and is the height so that the posterior aspect of the Ilium rests in the seated position, P and includes centrally the end of the Z-line Z1. The first lower section 21 is located predominantly at line V11. Clearly the first lower section 21, second lower section 23 and lower section 21 are not merely points on the vertical cross section D1 to D2 and A1 to A2 of the seat back 11 and seat bottom 15 but include regions around this line.

The lateral concavity at line V11 and V111 as shown in FIG. 7 is crucial in providing the posterolateral support of the pelvis. The radius of curvature of the seat back 11 at the transverse cross section line V11 is of a size to support the sides of the pelvis and the seat back has a decreasing transverse radius of curvature as it extends towards the bottom 14 of the seat back. It is this decrease in the concavity that provides the full lateral pelvic support.

The curves of the seat are specific in their arch and are measured by a fixed radius of curvature. In the hard seat form the dimensions are as follows:

The lower part of the upper substantially convex portion 13 along D1–D2 has a radius of 450 mm.

The concave lower portion 12 along D1–D2 has a radius of 400 mm.

The first transverse fixed radius of curvature along V11 has a radius of 480 mm.

The second transverse fixed radius of curvature along V111 at the bottom of the seat back 14 has a radius of 330 mm.

The transverse arch of X1 of the headrest has a radius of 310 mm.

The seat of the invention can be applied to various forms of seating with various amounts and types of cushioning. Therefore the undeformed dimensions of the seat may vary. For example the substantially convex upper portion 13 could be in the range of 365 mm to 450 mm. The dimensions of the seats of various embodiments, when in use, will closely relate to the dimensions of the hard seat form as the dimension in use will be with the padding compressed. Variations though will apply due to different compression forces at different points but will provide the same effect. The lower concave portion 12 could therefore be in the range of 400 mm to 540 mm. It is preferably 540 mm when the seat is in two parts so that when the seat back 11 is reclined the lower part of the concave lower portion 12 at the bottom of the seat back 14 does not project into the user. The substantially concave lower concave portion 12 may be shortened to also avoid this problem and a gap of up to 50 mm from the rear of the seat bottom 18 may be provided. The aesthetic arrangements can vary between each model in the range, i.e. the range of seating designs may differ visually by providing different height back supports (even to the full height of the user), seat depths and methods of mounting the seat.

The seat can be manufactured in a simple one piece format or in two or more pieces: i.e. seat back 11 and seat bottom 15. The basic shape may be aesthetically covered. The seat can be manufactured in any required manner, as determined when applying the aesthetics of a seat design model within the range. However, the essential element is to provide sacroiliac joint, gluteal, iliac crest and ilio-lumbar support and is the same in each design.

Figure 10:
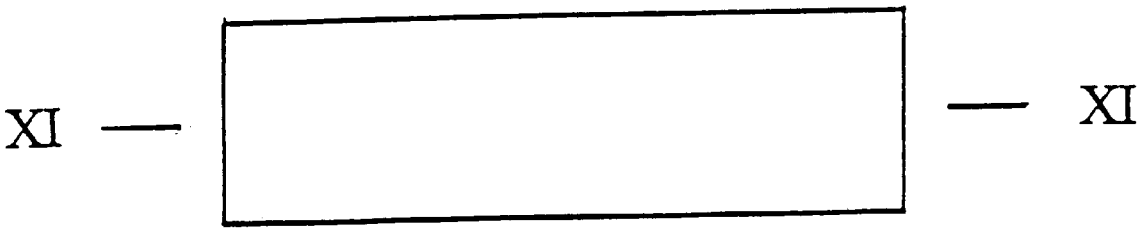
FIG. 10 is a front view of an embodiment of a headrest of seat of the invention.
Figure 11:
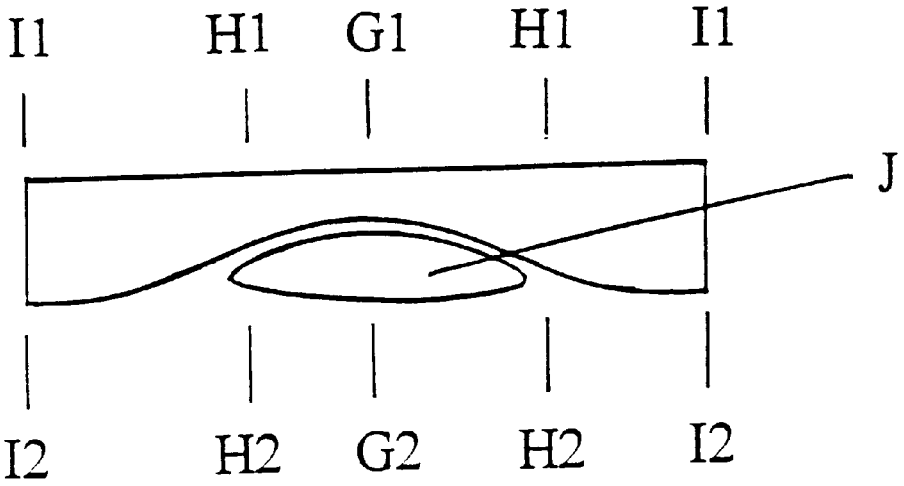
FIG. 11 is a cross section of headrest FIG. 10 along line X.
Figure 12:
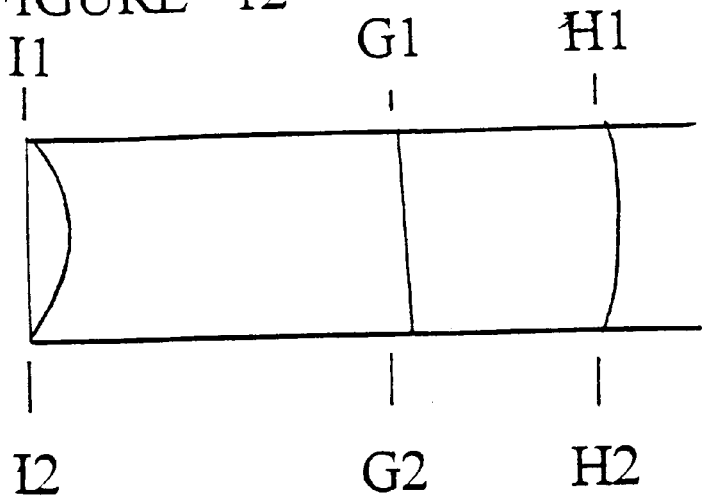
FIG. 12 is a cross section of headrest FIG. 11 line G1 to G2.

FIGS. 10–12 show the application of a headrest as used in this seat for its application in seating where the length of the back and the application demands its use. The area between lines H—H on FIG. 11 is the area involved in this application including the use of a pillow or cushion headrest. The other parts of these figures relate to aesthetics and will vary in its different applications.

The above description shows the invention and the necessary features which are provided for the invention to be satisfactorily applied. It will be appreciated that this description effectively provides the constraints met by the seats made in accordance with the invention and, whilst one embodiment has been described, generally, it will be appreciated that seats made in accordance with the invention may vary widely, provided they remain within the constraints of the invention as defined in the claims.

We claim:

1. A seat comprising a seat bottom and a seat back which can extend substantially upright relative to the seat bottom;

the seat bottom having a dished gluteal portion for receiving the buttocks of a user and a raised front portion for tending to retain the user in the dished gluteal portion;

the seat back having two lower sections, the first lower section positioned relative to the seat bottom to contact the posterior superior spine of the ilia while the user is seated and the second lower section positioned below the first lower section and part of a substantially vertically concave lower portion of the seat back to support the upper and middle gluteal;

the first lower section of the seat back and the lowest point of the dished gluteal portion are spaced relative to each other so as to have a specific Z-line dimension when in use corresponding to the average dimension between the posterior superior spine of the ilia and the ischial tuberosities (sit bones) of an adult person, and the concave lower portion of the seat back and the dished gluteal portion of the seat bottom being relatively positioned, whereby the two lower sections of the seat back and a lower section of the seat bottom around the lowest point of the dished gluteal portion are able to simultaneously support the pelvis of the user in a correct physiological sitting position for normal spinal integrity substantially corresponding to the pelvic standing position.

2. A seat in accordance with claim 1 wherein the Z-line dimension when in use is about 230 mm.

3. A seat in accordance with claim 2 wherein the seat back has a central upright profile comprising a substantially convex upper portion and the substantially concave lower portion with the first lower section of the seat back being at the junction of the upper and lower portions.

4. A seat in accordance with claim 3 vertically wherein the concave lower portion of the seat back has a fixed vertical radius of curvature in the range of 400 mm to 540 mm.

5. A seat according to claim 4 wherein the first lower section of the seat back is about 170 mm above the top of the dished gluteal portion of the seat bottom.

6. A seat in accordance with claim 4 wherein the seat back portion has a transverse concave shape with a first transverse fixed radius of curvature around the first lower section and a second transverse fixed radius of curvature below and sized smaller than the first transverse fixed radius of curvature for providing lateral support of the pelvis.

7. A seat in accordance with claim 6 wherein the first transverse fixed radius of curvature is about 480 mm.

8. A seat in accordance with claim 7 wherein the second transverse fixed radius of curvature is about 330 mm.

9. A seat according to claim 2 wherein the lowest central point of the dished gluteal portion of the seat bottom is about 100 mm in front of the first lower section of the seat back.

* * * * *